US009500402B2

(12) United States Patent
Kim et al.

(10) Patent No.: US 9,500,402 B2
(45) Date of Patent: Nov. 22, 2016

(54) DOOR FOR REFRIGERATOR AND MANUFACTURING METHOD FOR THE SAME

(71) Applicant: LG ELECTRONICS INC., Seoul (KR)

(72) Inventors: Junghun Kim, Changwon-si (KR); Sungwoo Choi, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/162,216

(22) Filed: Jan. 23, 2014

(65) Prior Publication Data

US 2014/0208657 A1 Jul. 31, 2014

(30) Foreign Application Priority Data

Jan. 30, 2013 (KR) ..... 10-2013-0010317

(51) Int. Cl.
*F25D 23/02* (2006.01)

(52) U.S. Cl.
CPC ..... *F25D 23/02* (2013.01); *Y10T 29/49826* (2015.01)

(58) Field of Classification Search
CPC .. F25D 23/02; F25D 23/028; F25D 2323/02; F25D 2400/06
USPC ..... 312/401, 405, 109, 326, 329
See application file for complete search history.

(56) References Cited

U.S. PATENT DOCUMENTS

| | | | | |
|---|---|---|---|---|
| 4,583,796 | A * | 4/1986 | Nakajima et al. | 312/405 |
| 5,048,233 | A * | 9/1991 | Gidseg et al. | 49/501 |
| 6,138,432 | A * | 10/2000 | Banicevic | 52/784.15 |
| 2008/0042537 | A1* | 2/2008 | Kim et al. | 312/405 |
| 2008/0120912 | A1* | 5/2008 | Crompton et al. | 49/372 |
| 2010/0287975 | A1* | 11/2010 | Lim | 62/449 |
| 2011/0089790 | A1 | 4/2011 | Lee et al. | |
| 2012/0326587 | A1 | 12/2012 | Jeong et al. | |

FOREIGN PATENT DOCUMENTS

| | | | |
|---|---|---|---|
| CN | 101231102 | A | 7/2008 |
| CN | 102042734 | A | 5/2011 |
| CN | 102840729 | A | 12/2012 |
| KR | 101339925 | B1 | 12/2013 |

* cited by examiner

*Primary Examiner* — James O Hansen
(74) *Attorney, Agent, or Firm* — Dentons US LLP

(57) ABSTRACT

There is disclosed a refrigerator door including a front panel for defining a front exterior appearance thereof, a door liner for defining a rear exterior appearance thereof, a frame for defining both lateral exterior appearance thereof, the frame formed of steel, a support portion provided in an inner portion of the frame to support the front panel, the support portion formed of steel, an upper cap decorative portion for sealing upper portions of the front panel and the door liner, a lower cap decorative portion for sealing lower portions of the front panel and the door liner, and a coupling member provided in an inner portion of the frame to couple the upper cap decorative portion and the lower cap decorative portion to each other, the coupling member formed of steel, wherein the support portion is welded to the frame and the coupling member is welded to the frame.

15 Claims, 10 Drawing Sheets

DOOR FOR REFRIGERATOR AND MANUFACTURING METHOD FOR THE SAME

Pursuant to 35 U.S.C. §119(a), this application claims the benefit of earlier filing date and right of priority to Korean Application No. 10-2013-0010317, filed on Jan. 30, 2013, the contents of which are hereby incorporated by reference herein in their entirety.

BACKGROUND OF THE DISCLOSURE

Field of the Disclosure

The present invention relates to a door for a refrigerator and a method of manufacturing the same.

Discussion of the Related Art

Refrigerators are classified into top mount freezer type refrigerators, side by side type refrigerators and bottom freezer type refrigerators. In a top mount freezer type refrigerator, a freezer compartment is mounted on a top portion and a refrigerator compartment is mounted in a bottom portion. In a side by side refrigerator, the refrigerator and freezer compartments are arranged side by side. In a bottom freezer type refrigerator, the freezer compartment is mounted in a bottom portion and the refrigerator compartment is mounted in a top portion.

The side by side type refrigerator has a relatively large capacity, with various combined functions. The refrigerator compartment and the freezer compartment are longitudinally mounted in right and left portions, respectively. A mechanism chamber is provided in a rear portion of the refrigerator compartment and an evaporator is mounted in the mechanism chamber. The evaporator is configured to suck internal air of the refrigerator and freezer compartments via a lower portion thereof and to exhaust air via an upper portion into the compartments such that the refrigerator and freezer compartments may perform a refrigerating function and a freezing function, respectively.

Meanwhile, a door for the refrigerator is rotatably coupled to a front surface of the refrigerator and the door is usually exposed to a user, when closing storage compartments. Various decorations are provided to the door to provide a user with the aesthetic sense and for example, a front panel having various patterns formed therein is attached to a front surface of the door.

Accordingly, many researches and studies are performed to ease a manufacturing process of the door for the refrigerator and to reinforce the strength of the door for the refrigerator.

SUMMARY OF THE DISCLOSURE

Exemplary embodiments of the present disclosure provide a door for a refrigerator having a reinforced strength and a method of manufacturing the same.

Exemplary embodiments of the present disclosure provide a door for a refrigerator which may maintain fixation strength of a front panel and give the user the aesthetic sense, and a method of manufacturing the same.

Exemplary embodiments of the present disclosure provide a door for a refrigerator which may be manufactured in a simple assembly process to enhance productivity, and a method of manufacturing the same.

To achieve these objects and other advantages and in accordance with the purpose of the invention, as embodied and broadly described herein, a refrigerator door includes a front panel for defining a front exterior appearance thereof;

a door liner for defining a rear exterior appearance thereof; a frame for defining both lateral exterior appearance thereof, the frame formed of steel; a support portion provided in an inner portion of the frame to support the front panel, the support portion formed of steel; an upper cap decorative portion for sealing upper portions of the front panel and the door liner; a lower cap decorative portion for sealing lower portions of the front panel and the door liner; and a coupling member provided in an inner portion of the frame to couple the upper cap decorative portion and the lower cap decorative portion to each other, the coupling member formed of steel, wherein the support portion is welded to the frame, and the coupling member is welded to the frame.

The front panel may be fixed to the frame.

One end of the refrigerator door may be an outer surface of the portion of the frame coupled to the front panel.

One end of the refrigerator door may be the portion of the frame extended to the front panel as far as the thickness of the frame.

The frame may include a first frame for defining a right exterior appearance thereof; and a second frame for defining a left exterior appearance thereof, and one or more of the first and second frames have an uneven horizontal cross section.

The coupling member may be projected from an inner surface of the frame.

The upper cap decorative portion and the lower cap decorative portion may be coupled to the coupling member by a screw.

The frame may have a predetermined shape worked not to face each other.

One or more of the frame, the support portion and the coupling member may be formed of a zinc galvanized steel plate.

A projection may be projected a predetermined height from one or more of the frame and the support portion, and the projection may provide a passage the zinc gas generated in the laser welding is exhausted along.

The projection may be formed in the contacting portion between the frame and the support portion.

The projection may be formed by a press process or a laser.

A projection may be projected a predetermined height from one or more of the frame and the coupling member and the projection, and the projection may provide a passage the zinc gas generated in the laser welding is exhausted along.

The projection may be formed in the contacting portion between the frame and the support portion.

One or more of a display seating portion for seating a display thereon and a handle are provided in the support portion.

One or more of the frame, the support portion and the coupling member are formed by a press process.

In another aspect, a manufacturing method of a refrigerator door includes press-working a frame for defining both lateral exterior appearances thereof, a support portion provided in an inner portion of the frame and a coupling member; welding the support portion and the coupling member to the frame; fixing a front panel to the support portion and provide an upper cap decorative portion and a lower cap decorative portion in the coupling member; installing a door liner, with injecting liquid-foam; and heating the liquid-foam.

Laser welding may be performed in the welding step.

The manufacturing method of the refrigerator door may further include forming a projection in the frame or the support portion.

The manufacturing method of the refrigerator door may further include forming a projection in the frame or the coupling member.

According to the embodiments of the present disclosure, the fixation strength of the front panel may be maintained and there is no welding trace remaining in the exterior appearance of the refrigerator door, such that the aesthetic sense for the refrigerator door may be provided to the user.

Furthermore, only the thickness of the frame is used only to fix the front panel. When seeing the refrigerator in front, the front panel may occupy a relatively large section, such that the aesthetic sense for the refrigerator door provided by the user may be enhanced.

Still further, elements may be manufactured by the press process such that it can be easy to work the refrigerator door and to enhance production efficiency.

Especially, the manufacturing process of the frame may be simplified and the assembly structure of the refrigerator door may be simplified, such that the quality reliability for the products may be enhanced.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

DESCRIPTION OF SPECIFIC EMBODIMENTS

Figure 1:
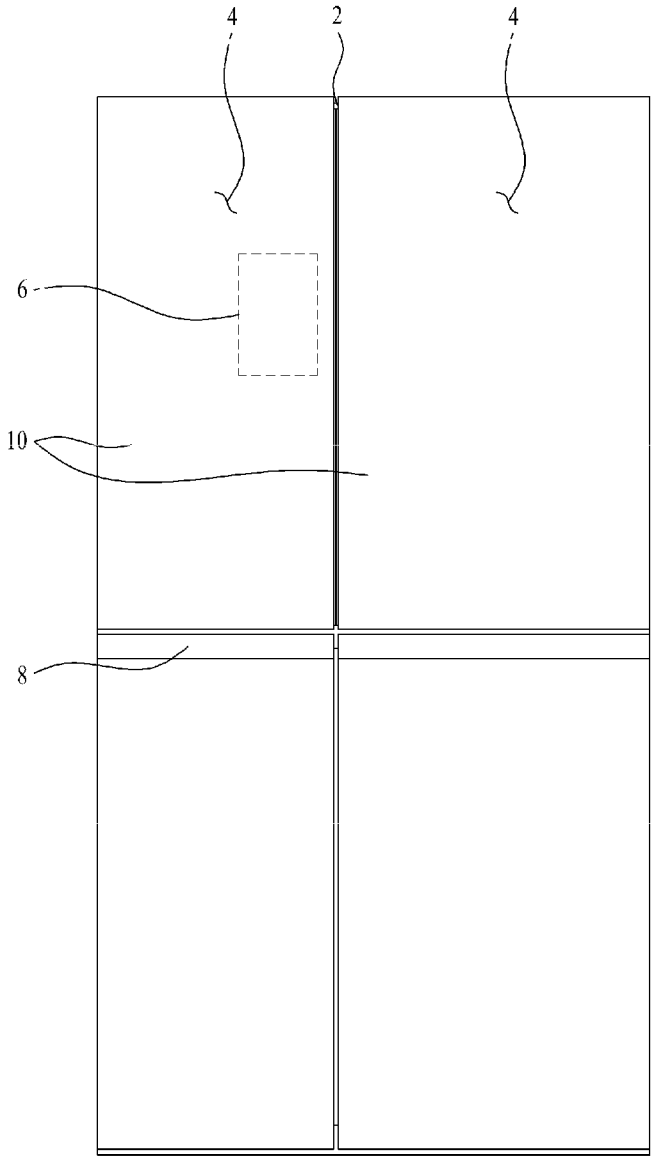
FIG. 1 is a front view of a refrigerator according to exemplary embodiments of the present disclosure.

Exemplary embodiments of the disclosed subject matter are described more fully hereinafter with reference to the accompanying drawings. The disclosed subject matter may, however, be embodied in many different forms and should not be construed as limited to the exemplary embodiments set forth herein.

Exemplary embodiments of the disclosed subject matter are described more fully hereinafter with reference to the accompanying drawings. The disclosed subject matter may, however, be embodied in many different forms and should not be construed as limited to the exemplary embodiments set forth herein. Rather, the exemplary embodiments are provided so that this disclosure is thorough and complete, and will convey the scope of the disclosed subject matter to those skilled in the art. In the drawings, the size and relative sizes of layers and regions may be exaggerated for clarity. Like reference numerals in the drawings denote like elements.

FIG. 1 is a front view of a refrigerator according to exemplary embodiments of the present disclosure. Hereinafter, the refrigerator according to the exemplary embodiments of the present disclosure will be described.

The door for the refrigerator according to the embodiments of the present disclosure may be applicable to a top mount type refrigerator having a freezer compartment and a refrigerator compartment for storing foods mounted in top and bottom portions, respectively, as a storage compartment 4 and a bottom freezer type refrigerator having the refrigerator and freezer compartments mounted in top and bottom portions, respectively.

However, the refrigerator described in the present disclosure is a side by side type refrigerator having the refrigerator and freezer compartments mounted side by side.

The refrigerator according to the embodiments of the present disclosure includes a storage compartment 4 having a freezer compartment and a refrigerator compartment and a case 2 having a mechanism chamber in which a freezing cycle device for compressing refrigerant (e.g., a compressor) is arranged.

A door 10 for the refrigerator (hereinafter, the refrigerator door 10) is coupled to a front surface of the case 2 to open and close the storage compartment 4 to provide the access to the storage compartment 4. At this time, the door for the refrigerator 10 is rotatably coupled to the case 2 such that the user may rotate the door for the refrigerator 10.

A display 6 may be provided in a front surface of the door 10 and the display 6 displays a temperature of the storage compartment 4 and a current state of the refrigerator to the user. The display 6 includes a touch screen and the user may input a control command to the refrigerator via the display 6.

In addition, a handle 8 is provided in the refrigerator door 10 and the user grasps the handle 8 when rotating the refrigerator door 10. As the handle 8 can be provided any portions giving the user easy access, the position of the handle shown is not limited to the position shown in FIG. 1.

In case two storage compartments 4 are provided in the refrigerator, two refrigerator doors 10 are provided to open and close the storage compartments, respectively.

The two refrigerator doors 10 may be formed in a similar structure symmetrically. Rotational directions of the two refrigerator doors 10 may be reverse and the display 6 may be provided in one of the two refrigerator doors 10.

To make the present disclosure understood easily, a left one of the two refrigerator doors 10 will be described. However, an internal structure of one refrigerator door is similar to an internal structure of the other and technical features disclosed in the present disclosure may be applied to the right refrigerator door.

Figure 2:
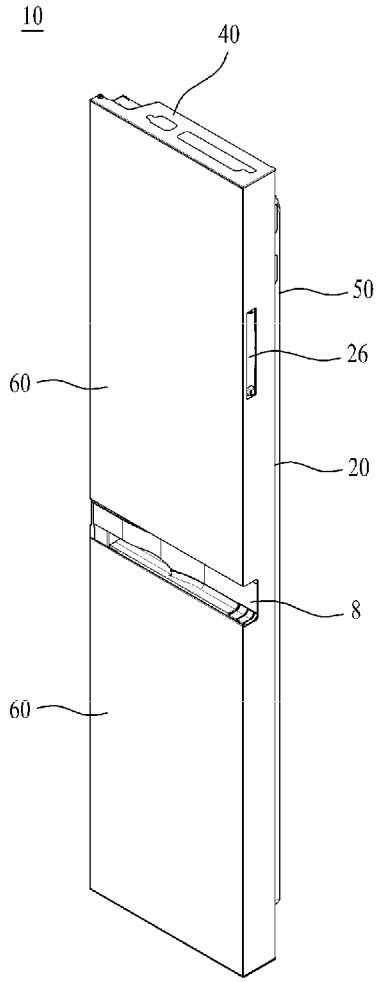
FIG. 2 is a diagram of a door for the refrigerator.
Figure 3:
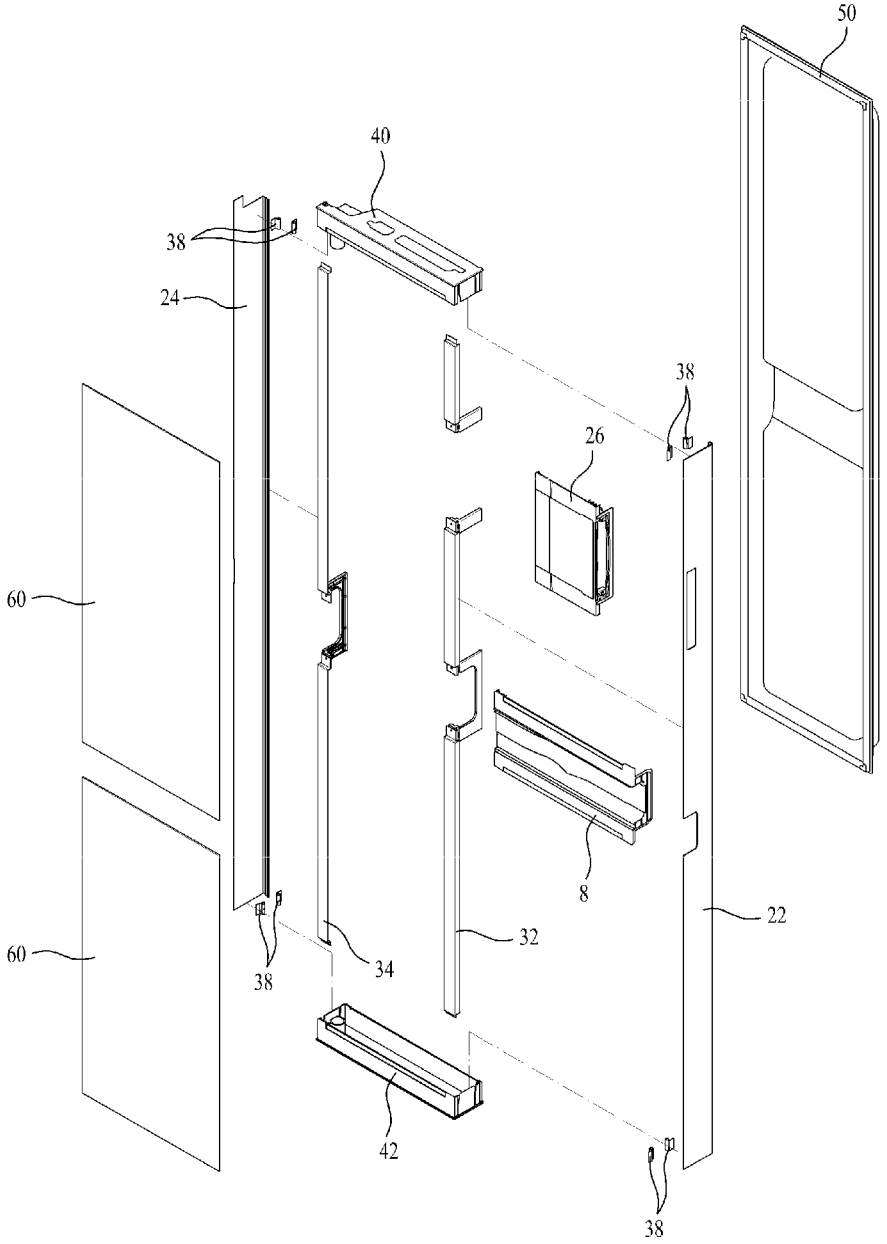
FIG. 3 is an exploded perspective diagram of FIG. 2.

FIG. 2 is a diagram illustrating the refrigerator door and FIG. 3 is an exploded perspective diagram of FIG. 2. Hereinafter, the refrigerator door is described, referring to FIG. 3.

The refrigerator door 10 includes a frame 20 for defining an exterior appearance of the refrigerator door and a support portion 30 welded to the frame 20. The support portion is welded to an inner surface of the frame 20 such that it may be invisible, seen from the outside the refrigerator door 10.

The support portion 30 may be welded to the frame 20, using a laser.

The frame 20 defines right and left portions of the refrigerator door 10, exposed to the user directly. It is preferred that the frame 20 has no unevenness or curvature to prevent an unpleasant feel to the user.

The frame 20 includes a first frame 22 for defining a right exterior appearance of the refrigerator door 10 and a second frame 24 for defining a left exterior appearance of the refrigerator door 10. The first frame 22 and the second frame 24 may form right and left boundaries of the refrigerator door 10.

At this time, at least one of the first and second frames 22 and 24 may have an uneven horizontal cross section. In other words, a horizontal cross section of the first or second frame 22 or 24 may be variable from along a downward direction. Accordingly, the first frame 22 and the second frame 24 have predetermined appearances difficult to be operated by roll forming.

Referring to FIG. 3, a groove is formed in the second frame 24 and a cross section of the portion having the groove is different from a cross section of the other portion having no groove.

The support portion 30 includes a first support portion 32 coupled to an inner surface of the first frame 22 and a second support portion 34 coupled to an inner surface of the second frame 24.

The first support portion 32 is welded to the first frame 22 by laser beams and the second support portion 24 may be welded to the second support portion 34.

At this time, the frame 20 and the support portion 30 may be formed of steel. In the present disclosure, the frame 20 and the support portion 30 are formed of steel and the strength of the refrigerator door can be enhanced.

Especially, the frame 20 and the support portion 30 are different from a frame and a supporting portion of a conventional refrigerator door which are formed of aluminum relatively weaker than steel, with an auxiliary strength reinforcing member for reinforcing the strength. The total number of the parts can be reduced and efforts for treating the parts can be reduced.

Meanwhile, laser is an abbreviation of light amplification by stimulated emission of radiation. In other words, the laser welding is the welding using output of laser beams. Ruby having a high output is usually used for carbon dioxide laser in the laser welding.

The laser welding has a high energy density and enables welding of high melting point metal. Also, the laser welding has a very small welding heat input and a narrow heat-affected zone. A heat source of the laser welding is a beam of light and it is possible to perform welding in any environment, using a transparent material.

The frame 20 and the support portion 30 may be formed by a press process. The press process refers to the work of cutting or molding a metallic material in various shapes, using a press. The frame 20 and the support portion 30 may be formed through a press process having one process, thereby simplifying the manufacturing process. In this instance, the time and costs required for manufacturing the frame 20 and the support portion 30.

The support portion 30 is also employed as a fixing portion for installing various elements provided in the refrigerator door 10. In other words, the front panel 60 for defining a front exterior appearance of the refrigerator door 10, a display seated portion 26 and the handle 8 may be fixed to the support portion 30.

At this time, the front panel 60 may be a glass plate formed of glass with a predetermined thickness. Various patterns, designs or colors may be processed in or on the front panel 60 and the user may be provided with the aesthetic sense.

Coupling members 38 may be provided in the first frame 22 and the second frame 24, respectively. At this time, two coupling members may be provided in an upper portion of the first frame 22 and two coupling members may be provided in a lower portion of the first frame 22. Also, two coupling members may be provided in an upper portion of the second frame 24 and two coupling members may be provided in a lower portion of the second frame 24. Eight coupling members 38 may be provided in one refrigerator door.

At this time, the coupling members 38 may be fixedly welded to the first frame 22 and the second frame 24. The coupling members may be welded to the first frame 22 and the second frame 24 with laser beams.

An upper cap decorative portion 40 for defining the upper appearance of the refrigerator door 10 or a lower cap decorative portion 42 for defining the lower appearance of the refrigerator door 10 may be coupled to the coupling members 38. A hole may be formed in the coupling member 38 to insert a screw therein such that the coupling member 38 can be fastened to the lower cap decorative portion 42 by the screw.

The coupling members 38 may provide sufficient fixation power for fixing the upper cap decorative portion 40 and the lower cap decorative portion 42. Accordingly, the separation of the upper cap decorative portion 40 and the lower cap decorative portion 42 may be prevented when liquid-foam is heated to generate bubbles in a space between the front panel 60 and a door liner 50. In other words, the coupling members 38 may provide sufficient fixation power to counter the bubble pressure to the upper cap decorative portion 40 and the lower cap decorative portion 42.

The coupling members 38 may be formed of steel and processed, using a press. In case a curvature has to be formed in the coupling member 38, a bending process may be additionally performed.

A door liner 50 is provided in a rear portion of the refrigerator door 10. The door liner 50 is provided to face the storage compartment 4, in a state where the storage compartment 4 is closed by the refrigerator door 10, such that cold air may not leak from the storage compartment 4.

The front panel 60 may be mounted to the front of the refrigerator door 10, with various patterns and designs formed therein. Accordingly, the user can recognize patterns or characters displayed on the display 6 arranged behind the front panel 60 to achieve information on an operation state of the refrigerator. At this time, the front panel 60 may be transparent or colorful.

Alternatively, two front panels 60 may be provided and the handle 8 may be arranged between the two front panels 60 to be held by the user.

Not shown in FIGS. 2 and 3, there is an empty space between the front panel 60 and the door liner 50 and liquid-foam is injected into the space to generate bubbles. Accordingly, the refrigerator door 10 may insulate the refrigerator so that the storage compartment keeps its temperature lower than a temperature outside.

As the liquid-foam is provided between the front panel 60 and the door liner 50, the strength of the refrigerator door 10 may be reinforced.

Figure 4:
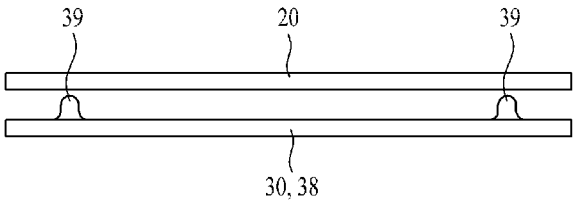
FIG. 4 is a diagram illustrating a laser welding method.

FIG. 4 is a diagram illustrating a welding process. Hereinafter, the welding process will be described, referring to FIG. 4.

The frame 20 and the support portion 30 are welded with laser beams. The frame 20 and the coupling members 38 are fixedly welded with laser beams. The frame 20, the support portion 30 and the coupling members 38 are formed of steel, and they may be manufactured of a zinc-galvanized steel plate to prevent corrosion. In other words, a zinc galvanized layer is deposited on the support portion 30 and the coupling members 38.

Accordingly, when a laser beam is irradiated to the frame 20, the support portion 30 and the coupling members 38 for the laser welding, the zinc applied in the zinc galvanized layer is melted. That is because zinc is melted and gasified at 400° C.

When the frame 20 and the support portion 30 are welded with a laser beam, zinc gas is exhausted and the zinc gas passes between the frame 20 and the support portion 30, only to form a predetermined gap in a moment. Specifically, the frame 20 and the support portion 30 are coupled to each other, with a predetermined gap, such that the coupling strength could weaken and also an error could be generated when the frame 20 and the support portion 30 are assembled to the refrigerator door.

To prevent such a gap, a projection 39 may be projected from the support portion 30 at a predetermined height to provide a passage the zinc gas, that is generated during the laser welding, can be exhausted along. The projection 39 may have a micro thickness and it may be formed smaller than the gap of the passage the zinc gas moves along. Accordingly, the strength can be enhanced, compared with the distance generated by the gap.

It is preferred that the projection 39 is formed in the contacting portion between the frame 20 and the support portion 30. That is because the zinc gas is generated in the contacting portion between the frame 20 and the support portion 30 and because a passage for the zinc gas has to be formed in the contacting portion.

When the frame 20 and the coupling members 38 are welded with a laser beam, zinc gas is exhausted and the zinc gas passes between the frame 20 and the coupling members 38, only to form a predetermined gap in a moment. Specifically, the frame 20 and the coupling members 38 are coupled to each other, with a predetermined gap, such that the coupling strength could weaken and also an error could be generated when the frame 20 and the coupling members 30 are assembled to the refrigerator door.

To prevent such a gap, a projection 39 may be projected from the support portion 30 a predetermined height, to provide a passage the zinc gas generated during the laser welding can be exhausted along. The projection 39 may have a micro thickness and it may be formed smaller than the gap of the passage the zinc gas moves along. Accordingly, the strength can be enhanced, compared with the distance generated by the gap.

It is preferred that the projection 39 is formed in the contacting portion between the frame 20 and the coupling members 38. That is because the zinc gas is generated in the contacting portion between the frame 20 and the coupling members 38 and because a passage for the zinc gas has to be formed in the contacting portion.

The projection 39 may be formed by a press process.

In case the projection 39 is formed by the press process, a predetermined portion in opposite to the contacting portion of the support portion 30 with the frame 20 is pressed to form the projection 39. The other opposite portion to the contacting portion of the coupling member 38 with the frame 20 may be pressed to form another projection 39.

Once one side of the steel plate is pressed by the press process, the other opposite side can be projected by the pressing force.

When the projection 39 is formed by the press process, it is preferred that the projection 39 is formed in the support portion 30 and the coupling members 38. If the frame 20 is pressed by the press process, unevenness would be generated in the frame 20 by the projection and the unevenness could be exposed to the user.

Alternatively, the projection 39 may be formed by a laser beam.

When a laser beam is irradiated to a conventional steel plate, the other side of the steel plate has a high temperature and two steel plates are laser-welded accordingly.

Using such property, the projection 39 may be formed by applying a laser beam to the coupling members 38 or the support portion 30.

Without contacting the supporting portion 30 with the frame 20, the supporting portion 30 and the frame 20 are spaced apart a predetermined distance from each other and a laser beam is irradiated to the support portion 30. In this instance, a temperature of the other opposite side of the support portion 30 to the side having the irradiated laser rises enough to expand the opposite portion a micro size. At this time, the surface of the support portion 30 having the irradiated laser has no change, which is caused by the property of the laser.

Hence, the support portion 30 and the frame 20 are positioned to contact with each other and a laser beam is irradiated continuously. After that, the support portion 30 and the frame 20 can be welded by the laser beam.

Similarly, without contacting the coupling members 38 with the frame 20, the coupling members 38 and the frame 20 are spaced apart a predetermined distance from each other and a laser beam is irradiated to the coupling members 38. In this instance, a temperature of the other opposite side of the coupling members 38 to the side having the irradiated laser rises enough to expand the opposite portion a micro size. At this time, the surface of the coupling members 38 having the irradiated laser has no change, which is caused by the property of the laser.

Hence, the coupling members 38 and the frame 20 are positioned to contact with each other and a laser beam is irradiated continuously. After that, the coupling members 38 and the frame 20 can be welded by the laser beam.

Especially, even when the laser beam is irradiated, there is no change in the shape of the surface having the irradiated laser according to the property. When the projection is formed by the laser, the projection 39 may be formed in the frame 20, not the coupling members 38 and the support portion 30.

The portion of the frame 20 exposed to the frame 20 is not affected by the laser and the unevenness exposed to the refrigerator door 10 may not be formed. Accordingly, the aesthetic sense provided to the user may not be deteriorated.

Figure 5:
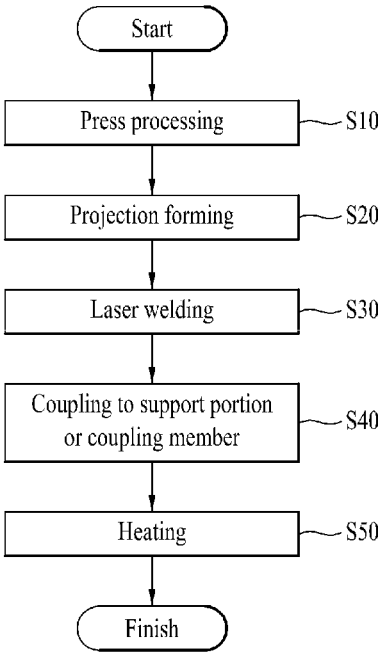
FIG. 5 is a flow chart illustrating a method of manufacturing the door for the refrigerator according to exemplary embodiments of the present disclosure.

FIG. 5 is a flow chart illustrating a method of manufacturing the refrigerator door according to one embodiment of the present disclosure.

Figure 6:
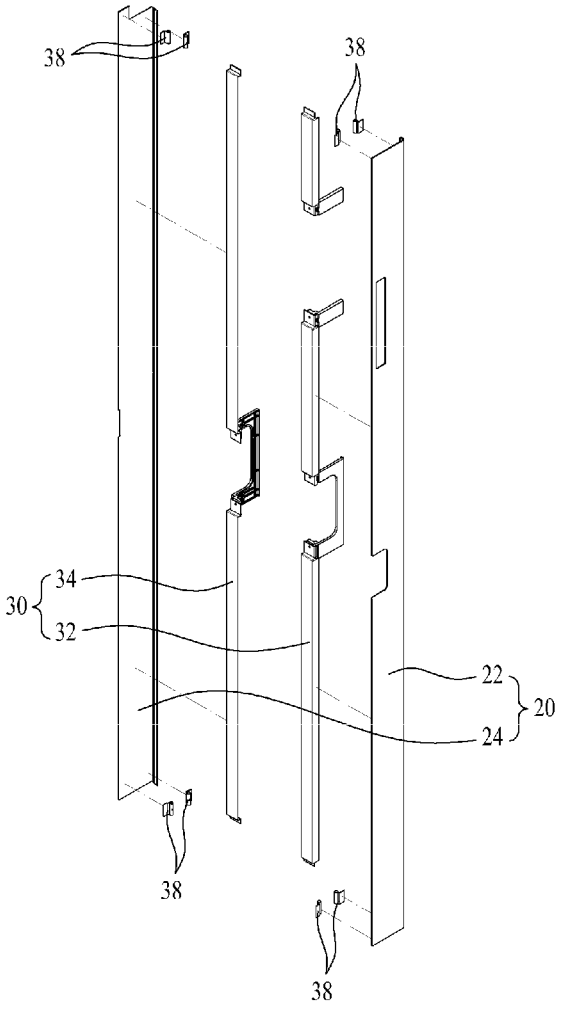
FIG. 6 is a diagram illustrating a frame, a support portion and a coupling member.
Figure 7:
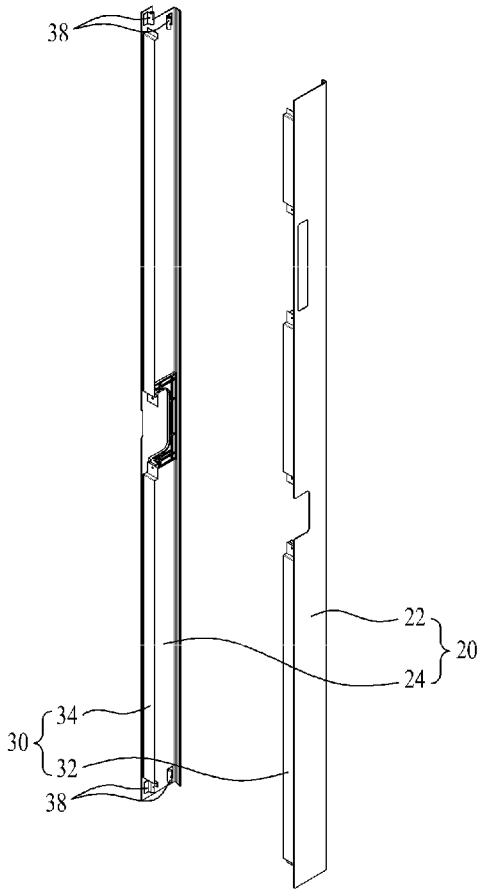
FIG. 7 is a diagram illustrating a coupling state among the elements shown in FIG. 6.
Figure 8:
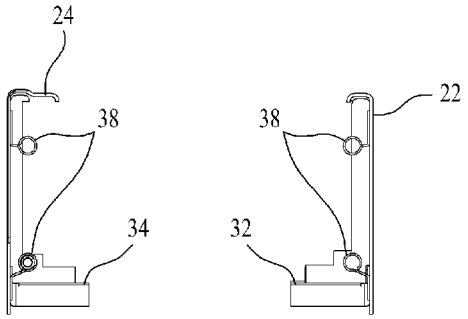
FIG. 8 is a plane view of FIG. 7.
Figure 9:
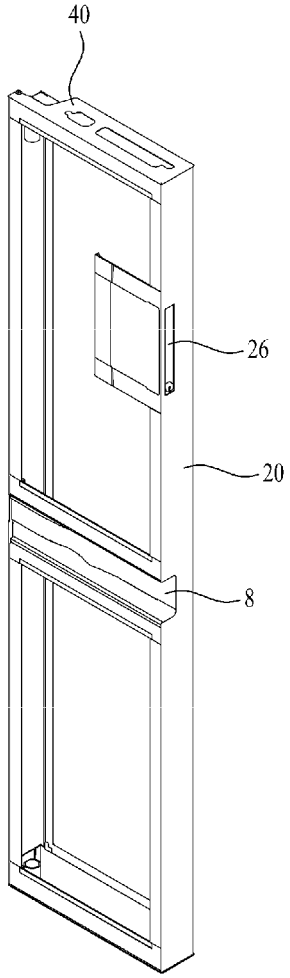
FIG. 9 is a diagram illustrating a coupling state among a seating portion, a handle, an upper cap decoration portion and a lower cap decoration portion.
Figure 10:
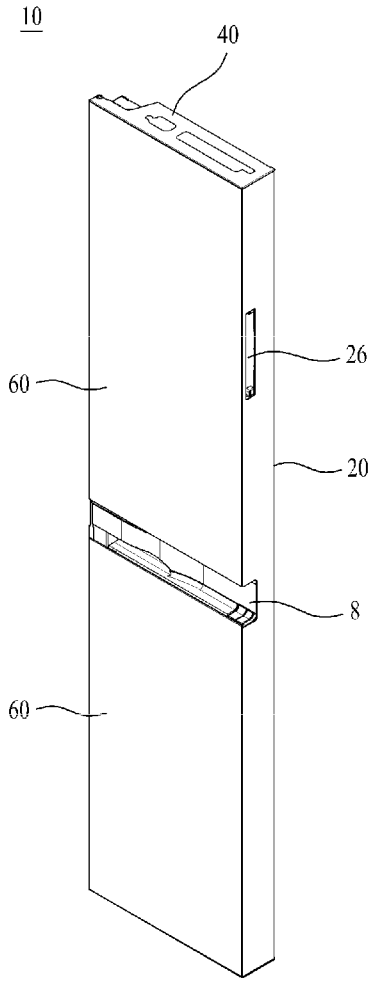
FIG. 10 is a diagram illustrating a coupling state of the front panel to the state shown in FIG. 9.

FIG. 6 is a diagram of the frame, the support portion and the coupling members. FIG. 7 is a diagram of the coupling state among them shown in FIG. 6 and FIG. 8 is a plane view of FIG. 7. FIG. 9 is a diagram illustrating a coupling state among the display seating portion, the handle, the upper cap decorative portion and the lower decorative portion. FIG. 10 is a diagram illustrating the front panel coupled to the state shown in FIG. 9.

Referring to FIGS. 5, 6, 7, 8, 9 and 10, the method of manufacturing the refrigerator door will be described.

As shown in FIG. 6, the frame 20 and the support portion 30 are worked by the press process (S10) shown in FIG. 5. At this time, it is possible to work the coupling members 38 in the press work. A coupling groove may be formed in the coupling member 38 by an auxiliary work (e.g., a bending work) and the coupling member 38 may be fastened to the upper cap decorative portion and the lower cap decorative portion via the coupling groove by a screw.

At this time, the frames 20 have a predetermined shape worked not to face each other and the shape will be described in detail later, referring to FIG. 11.

Even if it can be omitted, S20 is described to make an overall manufacturing method understood easily.

The projection 39 is formed in one at least of the frame 20, the support portion 30 and/or the coupling members 38 (S20).

In case the projection 39 is formed by the laser, a required portion of the frame 20, the support portion 30 and the coupling member 38 is selected and the projection 39 is worked in the selected portion of the frame 20, the support portion 30 and/or the coupling member 38.

However, in case the projection 39 is formed by the press work, it is preferred that the projection 39 is formed in the support portion 30 and the coupling member 38.

The projections 39 may be formed in the contacting portion between the frame 20 and the support portion 30 and between the frame 20 and the coupling member 38, respectively.

As shown in FIGS. 7 and 8, the frame 20, the support portion 30 and the coupling members 38 are fixedly welded to each other by the laser (S30). Since the laser welding is used in the coupling, there is less trace of the welding in the frame 20, the support portion 30 and the coupling member 38. Accordingly, quality deterioration, damage to exterior appearance and work tolerance which might be generated by the welding process may be reduced.

At this time, the first frame 22 is coupled to the first support portion 32 and the second frame 24 is coupled to the second support portion 34. The coupling members 38 are coupled to the inner surface of the frame 20.

The coupling members 38 are projectedly coupled to the inner surfaces of the first and second frames 22 and 24, such that the coupling between the upper cap decorative portion and the lower cap decorative portion may be eased and that a sufficient coupling force may be provided.

As shown in FIG. 9, the upper cap decorative portion 40 and the lower cap decorative portion 42 are installed in the coupling members (S40). The upper cap decorative portion 40 defines an upper exterior appearance of the refrigerator door 10 and the lower cap decorative portion 42 defines a lower exterior appearance of the refrigerator door 10.

The display seating portion 26 for seating the display 6 thereon and the handle 8 are coupled to the support portion 30. At this time, the display seating portion 26 and the handle 8 may be fixedly bonded to the support portion 30.

As shown in FIG. 10, the front panel 60 is installed to the refrigerator door 10. The front panel 60 defines the outer boundary of the refrigerator door 10 and the front panel 60 may be attached to the support portion 30 by an adhesive tape.

The liquid-foam is injected into the refrigerator door 10. Specifically, the liquid-foam is provided to the space defined by the front panel 60, the frame 20, the upper cap decorative portion 40 and the lower cap decorative portion 42.

Hence, the door liner 50 shown in FIG. 2 is installed. The door liner 50 defines a rear exterior appearance of the refrigerator door 10.

The refrigerator door 10 is heated and bubbles are generated (S50). At this time, the refrigerator door 10 may be heated, with a front-and-back side or a right-and-left side fixed by a jig. Such a jig prevents the refrigerator door 10 from being expanded in an unnecessary direction and the predetermined shape of the refrigerator door may be maintained.

Hence, the fabricated refrigerator door 10 is coupled to the case 2 of the refrigerator by a hinge and the refrigerator door 10 can be rotatable with respect to the case 2.

Figure 11:
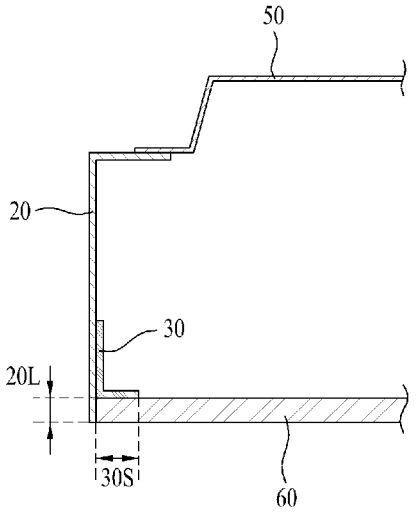
FIG. 11 is a cut-away diagram schematically illustrating a state where the frame, the support portion, a door liner and the front panel are coupled to each other.

FIG. 11 is a cut-away view schematically illustrating the state where the frame, the support portion, the door liner and the front panel are installed. Hereinafter, the state will be described in detail, referring to FIG. 11.

The front panel 60 is fixed by the frame 20 and the support portion 30. The frame 20 and the support portion 30 may support the front panel 60 vertically, only to enhance the coupling force with the front panel 60.

At this time, the front panel 60 may be fixed by a portion (20L) of the frame 20 longitudinally extended from the frame 20 and a portion (30S) of the support portion 30 vertically extended from the frame 20. The other opposite portion not shown in FIG. 11 may be similar to the shape shown in FIG. 11.

The frame 20 is arranged in one end of the refrigerator door and exposed to the user. According to the embodiments of the present disclosure, the thickness of the frame 20 and the front panel 60 are exposed, when the user sees the refrigerator door 10 in front.

That is because the front panel 60 can be supported by the thickness of one layer of the frame 20.

In other words, the end of the refrigerator door may be an outer surface of the portion where the frame 20 is fixed to the front panel 60. That is because the front panel 60 is fixedly coupled to an inner surface of the frame 20 and an outer surface of the frame 20 is exposed to the user.

Also, the end of the refrigerator door may be the portion extended from the front panel 60 as large as the thickness of the frame 20. Considering the width of the refrigerator door only based on what is shown in FIG. 11, only the portion where the front panel 60 is arranged and the thickness of the frame 20 forms the front surface of the refrigerator door 10.

Accordingly, the width of the front panel 60 increases in the refrigerator door 10 and the structure for supporting the front panel 60 can be thin such that patterns of the front panel 60 may be increased enough to increase the aesthetic sense provided to the user.

It is difficult to work patterns in the frame 20 and it is relatively easy to work pattern in the space where the front panel 60 is provided.

Meanwhile, the frames 20 have a predetermined shape worked not to face each other in one frame. In other words, the frame 20 is not worked for one surface to have an angle of 90 degrees or more.

In other words, the frame 20 shown in FIG. 11 has a perpendicularly bent shape, not a shape vertically bent several times. Accordingly, the frame 20 may be advantageously worked only by the press process, not by the roll foaming.

Especially, there is no space bent at 180 degrees such that the liquid-foam injected between the door liner 50 and the front panel 60 cannot be supplied to the bent space defined by the shape of the frame 20.

Specifically, if there is the bent space in the frame, the liquid-foam might be injected into the bent space. If the frame is heated in the state where the liquid-foam is injected, the bent space of the frame cannot but be expanded and widened. Accordingly, the overall shape of the refrigerator door might be deformed to cause a disadvantage of quality deterioration or a disadvantage of assembly tolerance.

Even though there is the bent space in the frame, the liquid-foam may not be injected to the bent space. Another type of foaming is performed, which is different from the foaming heated after the liquid-foam is injected into the bent space.

Accordingly, the two cases generate different results in the shape of the refrigerator door after the foaming or the effect of the heat insulation achieved by the liquid-foam injected into the inner portion of the refrigerator. In other words, there might be a problem that doors having different internal structure might be fabricated even though the same products are manufactured.

However, in the refrigerator door according to the embodiments of the present disclosure, there is no bent portion in the horizontal cross section of the frame and the deformation of the entire door shape which might be generated by the may be prevented.

Therefore, the quality of the refrigerator door 10 can be enhanced and a uniform quality of the product can be maintained.

Various variations and modifications of the refrigerator described above are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator door comprising:

a front panel for defining a front exterior appearance thereof;

a door liner for defining a rear exterior appearance thereof;

a frame for defining both lateral exterior appearance thereof, wherein the frame is formed of steel;

a support portion provided in an inner portion of the frame to support the front panel, wherein the support portion is formed of steel;

an upper cap decorative portion for sealing upper portions of the front panel and the door liner;

a lower cap decorative portion for sealing lower portions of the front panel and the door liner; and a coupling member provided in an inner portion of the frame to couple the upper cap decorative portion and the lower cap decorative portion to the frame, wherein the coupling member is formed of steel, wherein the front panel is fixed to the frame and wherein one end of the refrigerator door is the portion of the frame extended from the front panel as far as the thickness of the frame, and wherein one or more of a display seating portion for seating a display thereon and a handle are provided in the support portion.

2. The refrigerator door according to claim 1, wherein one end of the refrigerator door is an outer surface of the portion of the frame coupled to the front panel.

3. The refrigerator door according to claim 1, wherein the frame comprises:

a first frame for defining a right exterior appearance thereof; and a second frame for defining a left exterior appearance thereof, and at least one of the first and second frames have an uneven horizontal cross section.

4. The refrigerator door according to claim 1, wherein the coupling member is projected from an inner surface of the frame.

5. The refrigerator door according to claim 4, wherein the upper cap decorative portion and the lower cap decorative portion are coupled to the coupling member by a screw.

6. The refrigerator door according to claim 1, wherein the frame has a predetermined shape worked not to face each other.

7. The refrigerator door according to claim 1, wherein one or more of the frame, the support portion and the coupling member are formed of a zinc-galvanized steel plate.

8. The refrigerator door according to claim 7, wherein a projection is projected a predetermined height from one or more of the frame and the support portion, and the projection provides a passage the zinc gas generated in the laser welding is exhausted along.

9. The refrigerator door according to claim 8, wherein the projection is formed in a contacting portion between the frame and the support portion.

10. The refrigerator door according to claim 8, wherein the projection is formed by a press process or a laser.

11. The refrigerator door according to claim 7, wherein a projection is projected a predetermined height from one or more of the frame and the coupling member, and the projection provides a passage the zinc gas generated in the laser welding is exhausted along.

12. The refrigerator door according to claim 11, wherein the projection is formed in a contacting portion between the frame and the support portion.

13. The refrigerator door according to claim 1, wherein one or more of the frame, the support portion and the coupling member are formed by a press process.

14. A refrigerator door comprising:

a front panel for defining a front exterior appearance thereof;

a door liner for defining a rear exterior appearance thereof;

a frame for defining both lateral exterior appearance thereof, wherein the frame is formed of steel;

a support portion provided in an inner portion of the frame to support the front panel, wherein the support portion is formed of steel;

an upper cap decorative portion for sealing upper portions of the front panel and the door liner a lower cap decorative portion for sealing lower portions of the front panel and the door liner; and a coupling member provided in an inner portion of the frame to couple the upper cap decorative portion and the lower cap decorative portion to the frame, wherein the coupling member is formed of steel, wherein the front panel is fixed to the frame, wherein one end of the refrigerator door is the portion of the frame extended from the front panel as far as the thickness of the frame, wherein one or more of the frame, the support portion and the coupling member are formed of a zinc-galvanized steel plate, wherein a projection is projected a predetermined height from one or more of the frame and the support portion, and the projection provides a passage the zinc gas generated in the laser welding is exhausted along, and wherein the projection is formed in a contacting portion between the frame and the support portion.

15. A refrigerator door comprising:

a front panel for defining a front exterior appearance thereof;

a door liner for defining a rear exterior appearance thereof;

a frame for defining both lateral exterior appearance thereof, wherein the frame is formed of steel;

a support portion provided in an inner portion of the frame to support the front panel, wherein the support portion is formed of steel;

an upper cap decorative portion for sealing upper portions of the front panel and the door liner;

a lower cap decorative portion for sealing lower portions of the front panel and the door liner; and a coupling member provided in an inner portion of the frame to couple the upper cap decorative portion and the lower cap decorative portion to the frame, wherein the coupling member is formed of steel, wherein the front panel is fixed to the frame, wherein one end of the refrigerator door is the portion of the frame extended from the front panel as far as the thickness of the frame, wherein one or more of the frame, the support portion and the coupling member are formed of a zinc-galvanized steel plate, wherein a projection is projected a predetermined height from one or more of the frame and the coupling member, and the projection provides a passage the zinc gas generated in the laser welding is exhausted along and wherein the projection is formed in a contacting portion between the frame and the support portion.

* * * * *